United States Patent [19]

Hani et al.

[11] 4,204,586

[45] May 27, 1980

[54] SILENCER ON THE INTAKE SIDE OF A COMPRESSOR WITH ASSEMBLY OF AXIALLY SPACED ANNULAR SOUND-DAMPING ELEMENTS

[75] Inventors: August Häni, Turgi; Hansulrich Hörler, Zurich; Hans Ursprung, Turgi, all of Switzerland

[73] Assignee: BBC Brown Boveri & Company Limited, Baden, Switzerland

[21] Appl. No.: 951,049

[22] Filed: Oct. 13, 1978

Related U.S. Application Data

[63] Continuation of Ser. No. 725,121, Sep. 20, 1976, abandoned.

[30] Foreign Application Priority Data

Dec. 11, 1975 [CH] Switzerland ..... 16088/75

[51] Int. Cl.[2] ..... F02M 35/00

[52] U.S. Cl. ..... 181/229; 181/256; 181/268; 181/269; 181/280; 181/275

[58] Field of Search ..... 181/214, 229, 230, 240, 181/256–258, 265, 279, 280, 213, 224, 264, 268, 204, 275, 269; 415/119

[56] References Cited

FOREIGN PATENT DOCUMENTS

| | | | |
|---|---|---|---|
| 2600860 | 6/1977 | Fed. Rep. of Germany | 415/119 |
| 811612 | 4/1959 | Switzerland | 415/119 |

*Primary Examiner*—L. T. Hix
*Assistant Examiner*—Benjamin R. Fuller
*Attorney, Agent, or Firm*—Burns, Doane, Swecker & Mathis

[57] ABSTRACT

A silencer construction for connection to the intake side of a compressor comprises an assembly of axially spaced annular sound damping elements which form air in-flow passages therebetween. The sound damping assembly is located in a radially outer annular chamber of the silencer housing and the radially inner circumference of each of the sound damping elements merges into a curvilinear air guiding element which functions to deflect the partial air flows leaving the passages between the damping elements in the direction of the main air flow into a convergent intake manifold of the compressor.

11 Claims, 3 Drawing Figures

Figure 1:
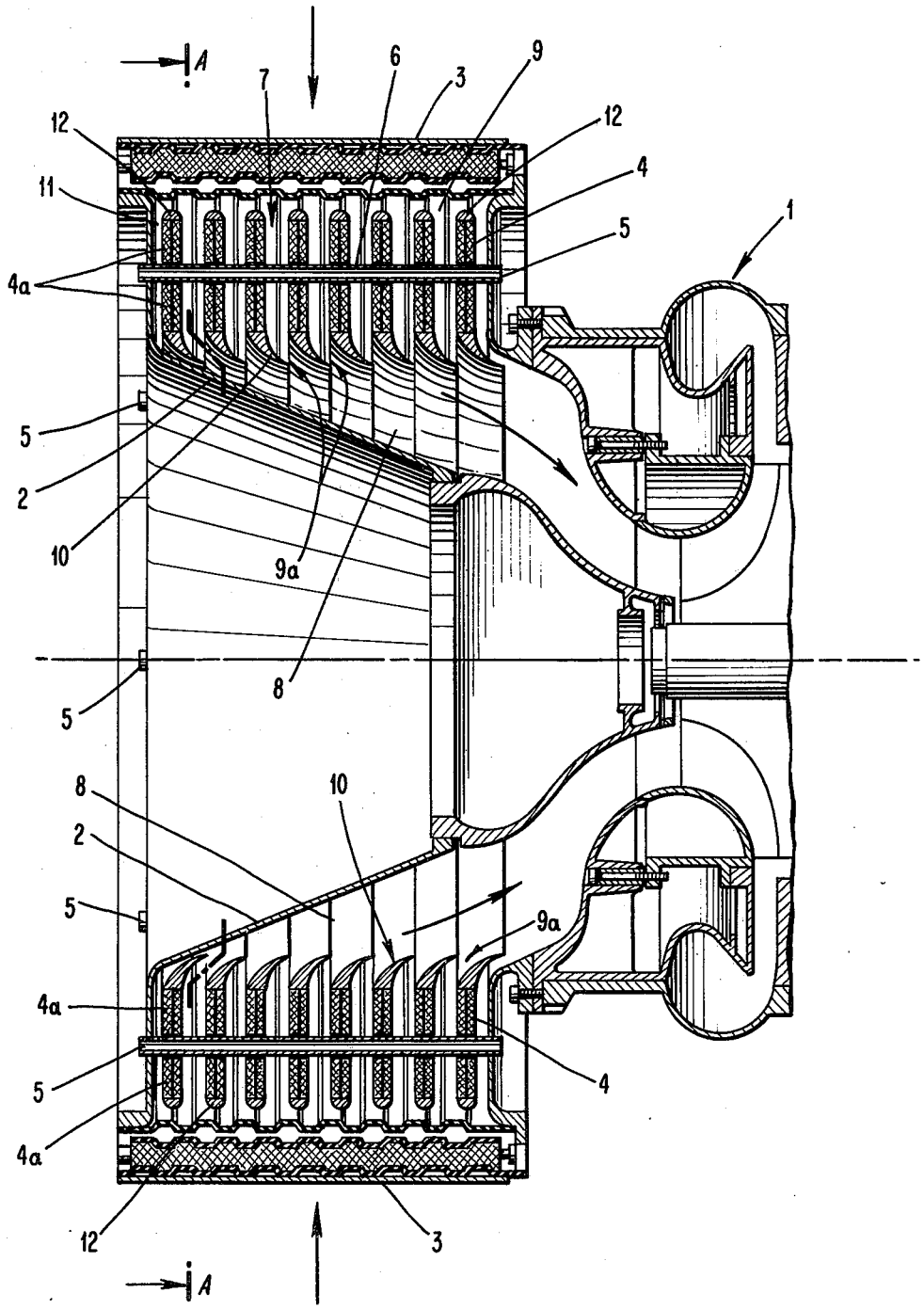

SILENCER ON THE INTAKE SIDE OF A COMPRESSOR WITH ASSEMBLY OF AXIALLY SPACED ANNULAR SOUND-DAMPING ELEMENTS

This is a continuation of application Ser. No. 725,121, filed on Sept. 20, 1976, now abandoned.

The present invention concerns a silencer on the intake side of a compressor with several ring-shaped sound-damping elements, and also flow passages, formed by these elements, which guide the ingested air in partial flows into a convergent manifold serving as the main flow path to the compressor.

In an exhaust-gas turbocharger the combustion air is compressed in a compressor driven by an exhaust-gas turbine and fed to the internal-combustion engine. In most cases a silencer attached to the compressor housing is provided to attenuate the sound waves occurring in operation. Outside air flows via a filter arranged around the circumference of the silencer into the inner space of the silencer which is fitted with sound-damping elements.

With regard to the air flow, the inner space of the silencer consists of two different chambers. In the outer chamber, viewed in the radial direction, the air flows radially inwards at low velocity over a relatively large flow cross-section, whereas in the inner chamber, which has the form of a convergent manifold, it flows approximately axially at high velocity over a relatively small flow cross-section.

In a silencer known of this kind the sound-damping elements each have a cylindrical portion and a disc-shaped portion and are arranged coaxially with respect to one another in the inner space of the silencer in such a way that a very large proportion of the sound-damping area is located in the manifold, in which considerable pressure losses occur owing to the high velocities prevailing here. In the annular chamber, on the other hand, in which the pressure losses are relatively small owing to the prevailing low velocities, there are only relatively small sound-damping surfaces, and so the possibilities for favourable flow conditions are not exploited to the full.

In another known silencer the annular chamber is better utilised by an arrangement of larger damping surfaces, and a few flow-deflecting elements are also provided which deflect a part of the air in the direction of the main flow, but where the flow passages emerge into the manifold substantial eddy losses occur owing to the different flow directions and velocities.

Both of the silencing arrangements mentioned have the additional drawbacks that in order to obtain sufficient sound attenuation, surfaces of different kinds in the inner space of the silencer are provided with sound-damping material, which complicates manufacture. Such silencers, which incur high flow losses and are complicated to make, require a disproportionately high expenditure of time and effort, especially with the high compressor speeds now customary and the new noise regulations, which limit the permitted noise level.

The object of this invention is to create a silencer of the kind stated above in which the flow losses and manufacturing costs are lower than for the known silencers, and the sound attenuation is satisfactory even at high compressor speeds.

This object is achieved by having the sound-damping elements each merge at a respective inner circumference into a curved guiding element with a shape that deflects the partial flows leaving the flow passages in the direction of the main flow established in the convergent manifold. The sound-damping elements are arranged such that the sum of the leaving cross-sections of all of the flow passages is at least approximately equal to the average flow cross-section of the manifold. In this way, the velocity of the air is lower in the silencer chamber than in the convergent manifold.

One of the advantages of the silencer of the invention is that the damping elements and hence the sound-attenuating surfaces are located in the outer annular chamber of the silencer, where velocities are lower and hence the pressure losses are also low. In addition the velocity vector of the partial flows flowing slowly through the flow passages is matched to the velocity vector of the main flow, thus avoiding eddy losses. Further, it is possible to use damping elements of the same kind in a modular system of construction which makes manufacture efficient and economical. Manufacture is also simplified and cost effectiveness is improved in the present invention because the sound attentuation is so effective that no additional surfaces in the inner chamber of the silencer have to be provided with sound-damping material.

Figure 2:
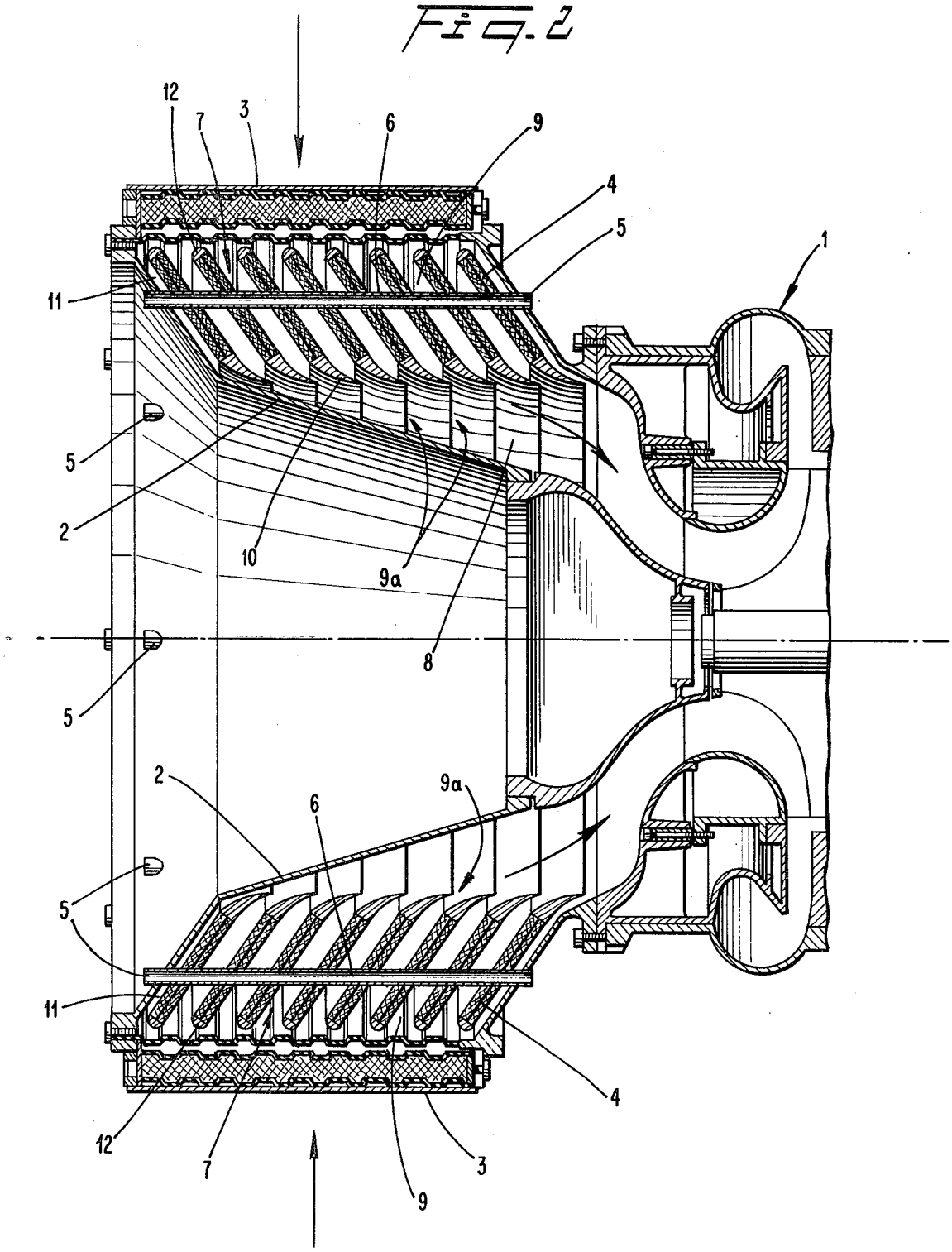
Figure 3:
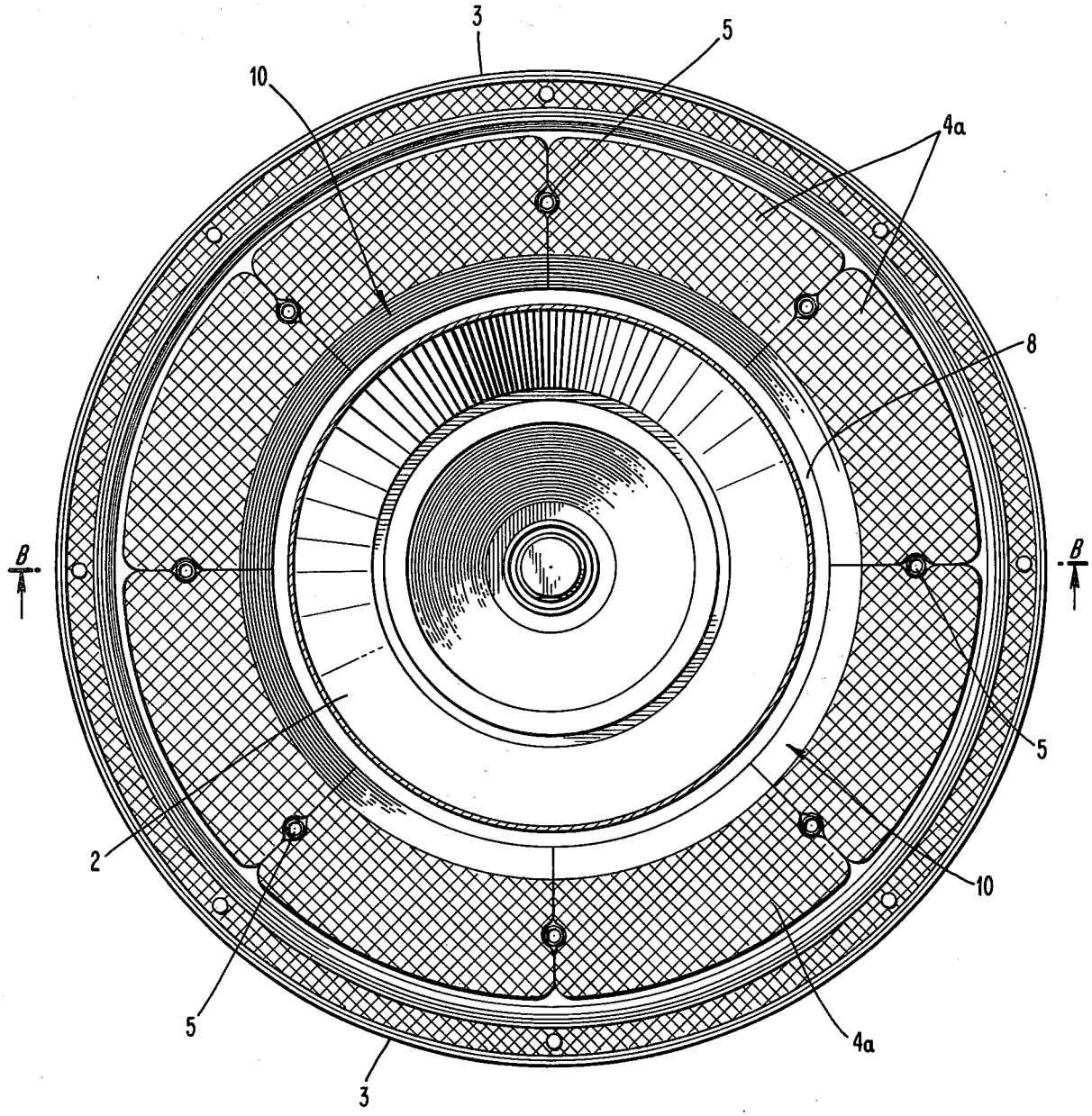

Examples of the invention are explained in the following with reference to the accompanying drawings, in which:

FIG. 1 shows a cross-section through a silencer with disc-shaped damping elements and through the compressor of an exhaust-gas turbocharger, FIG. 2 shows a section similar to that in FIG. 1, but through a silencer with cone-shaped damping elements, and FIG. 3 shows a cross-sectional view through lines A—A of FIG. 1.

In the figures, identical parts are identified by the same reference symbols.

The silencer shown in FIG. 1 comprises a housing 2 which sweeps through 360° about a central axis (shown in FIGS. 1 and 2 as a dashed line). The housing is rigidly fixed to the compressor 1 of an exhaust-gas turbocharger, the filter elements 3 arranged around the circumference of the housing. A number of essentially disc-shaped, annular sound-damping elements 4 are located in the inner space of the silencer. In the embodiments of FIGS. 1 and 2, eight such annular, sound-damping elements are illustrated. A greater or lesser number of elements 4, however, may be utilized without departing from the spirit of the invention. The damping elements fixed together and to the housing 2 by means of several tie rods 5 distributed around an intermediate the circumference of the damping elements 4. Spacers 6 which are arranged on the rods 5 are used to hold the various damping elements 4 held apart from each other at the required distances. The damping elements 4 containing the sound-damping material 4*a* are located in an annular chamber 7 of the inner space of the silencer and form bounding surfaces of flow passages 9 which emerge into a convergent manifold 8. The flow passages conduct partial flows of the air flowing in via filter segments 3 radially inwards at relatively low velocity in the direction of the manifold 8.

The damping elements 4 have a rounded nose or end 12 for smooth inflow and are shaped at their inner circumference as guiding elements 10. These are curved and of such a shape that they deflect the partial flows passing through the damping elements from the radial flow direction to the direction of the main flow established in the manifold 8. The leaving cross-sections 9a of the flow passages 9 formed by the guiding elements 10 are of such a size that their sum is about equal to the average flow cross-section in the manifold 8. The result of this is that the velocity vector of the air leaving the passages 9 corresponds approximately to the mean value of the velocity vector of the main flow. In this way eddy losses in the partial flows on leaving are largely avoided and the pressure drop in the silencer is reduced.

All of the damping elements 4 as shown in FIG. 1 are the same with regard to all of the shape and dimensions and bound passages 9 are the same with regard to shape and dimension, with the exception of the two end passages. The damping elements may consist of several segments instead of a closed one-piece ring. The arrangement of the damping elements as consisting of several segments instead of a closed one piece ring is illustrated in FIG. 3. It should be noted that FIG. 1 illustrates a silencer according to the present invention having either a closed one piece ring or an arrangement consisting of several segments since FIG. 1 is a cross sectional view passing through the damping elements as indicated by the lines B—B of FIG. 3. The end passages 11 have an axial width is roughly half the axial width of the passages 9 and accordingly carry roughly half the air flow of passages 9. At their outer circumference the damping elements 4 have rounded ends 12 which improve the inlet flow conditions. All sound-damping surfaces are located in the annular space 7, where the air velocity, and hence the pressure losses, are low. No inner surfaces of the housing 2 are provided with sound-damping material because the sound attenuation is adequate without this measure.

Instead of disc-shaped, the damping elements can also be conical, as shown in FIG. 2, with the flow passages 9 being generally radial but directly axially inward toward the compressor 1. Further, the sound-damping elements may have a curved cross-section in the vicinity of the tie rods 5 with correspondingly curved flow passages.

The spacers 6 are provided to maintain the distance between the damping elements 4 with the length of the spacers determining the width of the passages 9. This length of the spacers is dimensioned according to the desired relationship between pressure drop and sound attenuation which relationship can easily be varied by using spacers of another length, and hence altering the passage width.

It is also to be noted that the silencer described can be used for all kinds of compressor, for example exhaust-gas turbochargers, blast furnace blowers or gas turbine installations.

We claim:

1. In a silencer construction for connection to the intake side of a compressor which comprises an assembly of axially spaced annular sound damping elements forming air flow passages therebetween, said damping elements being located in a housing part of the silencer which is connected to a convergent intake manifold serving as the main flow path for the ingested air which flows inward through the spaces between the damping elements, the improvement wherein an inner circumference of each of said damping elements merges into an air guiding element having a curvilinear configuration which functions to deflect the partial air flows leaving said air passages between said damping elements in the direction of the main air flow established by said convergent manifold, and wherein the sum of the leaving cross-sections of all of said partial air flow passages is approximately equal to the average flow cross-section of said manifold.

2. A silencer as defined in claim 1 wherein said axially spaced annular damping elements are of identical shape and dimensions and thus form identical bounding surfaces of the air passages therebetween.

3. A silencer as defined in claim 1 and wherein end air flow passages are formed respectively between the endmost located damping elements in the assembly and the adjacent wall portions of said housing, the axial width of said end air flow passages being approximately half the axial width of the partial air flow passages between adjacent damping elements.

4. A silencer as defined in claim 1 wherein each of said axially spaced annular damping elements has a disc-shaped configuration.

5. A silencer as defined in claim 1 wherein each of said axially spaced annular damping elements has a conical configuration.

6. A silencer as defined in claim 1 wherein each of said axially spaced annular damping elements have a curvilinear configuration.

7. A silencer as defined in claim 1 wherein each of said axially spaced annular damping elements is constituted by a plurality of circumferentially arranged segments.

8. A silencer as defined in claim 1 wherein the outer circumference of each of said annular damping elements is rounded.

9. A silencer as defined in claim 1 wherein said housing part includes a radially inner annular chamber portion and a radially outer annular chamber portion and wherein all sound damping surfaces of said annular damping elements are located in the radially outer annular chamber portion of the silencer housing part.

10. A silencer as defined in claim 1 wherein tie rods distributed around the circumference of said damping elements pass axially through said elements and function in conjunction with spacer elements located between adjacent damping elements to secure said assembly of damping elements in axially spaced relation and to said housing, the length of said spacer elements determining the width of said partial air flow passages between adjacent damping elements and their size being determined in accordance with a desired relationship between pressure drop and sound attenuation.

11. A silencer as defined in claim 10 wherein said spacer elements are mounted on said tie rods.

* * * * *